US006224401B1

(12) United States Patent
Yu

(10) Patent No.: US 6,224,401 B1
(45) Date of Patent: May 1, 2001

(54) SOCKET WITH SAFETY DEVICE

(76) Inventor: Tsung-I Yu, No. 45, Sec. 3, Pa Te Rd., Pan Chiao City (TW)

( * ) Notice: Subject to any disclaimer, the term of this patent is extended or adjusted under 35 U.S.C. 154(b) by 0 days.

(21) Appl. No.: 09/492,281

(22) Filed: Jan. 27, 2000

(51) Int. Cl.[7] ..... H01R 13/44
(52) U.S. Cl. ..... 439/139
(58) Field of Search ..... 439/135–142

(56) References Cited

U.S. PATENT DOCUMENTS 3,930,704 * 1/1976 Dekanic ..... 339/42
3,980,372 * 9/1976 Ranzanigo ..... 339/41
4,179,175 * 12/1979 Farnsworth et al. ..... 339/42
4,707,042 * 11/1987 Haden ..... 439/140
4,932,886 * 6/1990 Glaser ..... 439/137
5,096,432 * 3/1992 Cullen et al. ..... 439/139
5,252,082 * 10/1993 Hsieh et al. ..... 439/141
5,267,870 * 12/1993 Maresh ..... 439/139
5,466,164 * 11/1995 Miyazaki et al. ..... 439/140
5,702,259 * 12/1997 Lee ..... 439/137
5,902,140 * 5/1999 Cheung et al. ..... 439/139
5,915,981 * 6/1999 Mehta ..... 439/137
6,015,306 * 1/2000 Jen ..... 439/139

* cited by examiner

*Primary Examiner*—Tulsidas Patel
*Assistant Examiner*—Michael Carroll
(74) *Attorney, Agent, or Firm*—Varndell & Varndell, PI

(57) ABSTRACT

The invention is directed to an electrical socket with a safety device. The electrical socket houses electrical components and includes a top lid having two openings for receiving an electrical plug. The safety device includes a security member having rectangular shoes blocking the two openings of the top lid of the electrical socket. The security member operates to expose the electrical components housed in the electrical socket when both of the shoe members are pushed inward simultaneously. On the other hand, the security member operates to prevent exposure of the electrical components housed in the electrical socket, if only one of the shoes is pushed inward.

8 Claims, 6 Drawing Sheets

SOCKET WITH SAFETY DEVICE

BACKGROUND OF THE INVENTION (a) Field of the Invention

Socket with safety device, more specifically socket comprising a revolvable security member by virtue of a blocking detent outstanding from both sides thereof an angular displacement will occur in the event one of both insert holes of the socket is being attempted unilaterally with a foreign material, the chassis is thereby safeguarded, and inroad by the intruding foreign material blocked; conversely, when a plug is being inserted with both legs altogether introduced simultaneously, the same safety device will yield by sinking directly, retract in, and by the guiding effect of the chassis the safety device will rotate to bid in the incoming plug to go down to the dead point, resting in place.

(b) Description of the Prior Art

Energy indispensable to daily living comes in a variety of forms, such as, for example, kinetic power, thermal power, etc., among which the electric power, in particular, is an essential source to the realization of power vested in other forms such as aforementioned kinetic or thermal power, electric power by and large is transmitted to cities and countrysides by power plants and power cable systems, yet to facilitate ready acquisition of electric power, plant generated power must be guided and led all the way down to the sockets mounted in civilian households or plant workshops, elsewhere indoors, sockets in this sense serving rightly to accommodate procuration of electricity to keep electric appliances working to which the electricity is the sole form of working power, by way of wire or leaders. That being the condition precedent, that is why in the household of a modern family there are so many sockets installed in place, indeed including extension sockets extended by extension wires, all serving the sole purpose of facilitating ready procuring of electric power for the benefit of the user, structurally, a socket comprises two inlet holes on the surface aligned straight to the conductor pieces mounted inside, so that once a plug by its two prongs is being inserted flat into the socket, conduction will make forthwith, such being a conventional design known to everybody, and needs not be given further detail as to its structure.

Something somewhat regrettable with such conventional design is that the socket is often installed on the wall about one foot above the floor, not to mention that an extension socket where used, is usually left at random on the ground, such a disposition of easy access would invite pitiably young kids in the house, as is often the case, to get nail, screwdriver, toy at hand, other implements and with same tamper with, attempt to make inroads into the insertion holes on the socket, installed on the wallfoot or left over aground inclusive, and that could strike a shock incident anytime and anywhere, reports of incidents as such are read from time to time on journals everywhere; moreover, the design for the insertion holes to communicate with the conductor pieces straight could easily incur dust accumulation or invite tiny insects to dwell within, that in the long run undermine the intended conducting purposes or result in oxidation followed by damage of the conductor pieces, shortcomings enumerated as such have for long been a target justified for improvement by the industrial communities; in that light the present invention provides the design of a socket with safety device which hopefully will eliminate all those regrettable possibilities associated with the use of a conventional design without prejudicing the conveniences to procure electric power supply where user's interest is concerned.

SUMMARY OF THE INVENTION

The primary object of the invention, therefore, lies in the provision of a socket with safety device which comprises a revolvable security member within, substantially T shaped, forming a hedge to the access holes, the ground level hole and the B plus hole, to be specific, the bottom of the security member is in the form of a round axis on either side in front juts a blocking detent whereby the security member may retract vertically once a plug by its two legs is inserted into the socket at the same time, the detent on contact with the chassis is guided into rotation whereby the ingoing plug may rest inserted in full to access electricity; should a non-conforming, that is, a foreign material gets inserted via a single hole, not both, the security member will respond to effect an angular displacement, resulting in having the detent on the side of the round axis to bear upon the chassis, the security member checked from sink-down, disabled from autonomous rotation, the intruding foreign material thus obstructed by the security member, shock is prevented altogether.

A further object of the invention is to provide a socket with a safety device whereof the insert lid comprises three holes, that is, incorporating one neutral static hole apart from the normally provided B plus holes and ground hole, correspondingly to the third neutral hole there is hinged a lid plate within, forming a coat upon the inner part of the neutral hole by the intervention of a torsion spring, such an inner lid plate may be pushed by a neutral leg that is being applied into the socket, as part of an ingoing plug, and which leg, once pulled up, will leave the lid plate restoring a lid-on state, thus enabling a three-hole socket to prevent dust inroads anytime, whether or not in use.

DETAILED DESCRIPTION OF THE PREFERRED EMBODIMENTS

Figure 1:
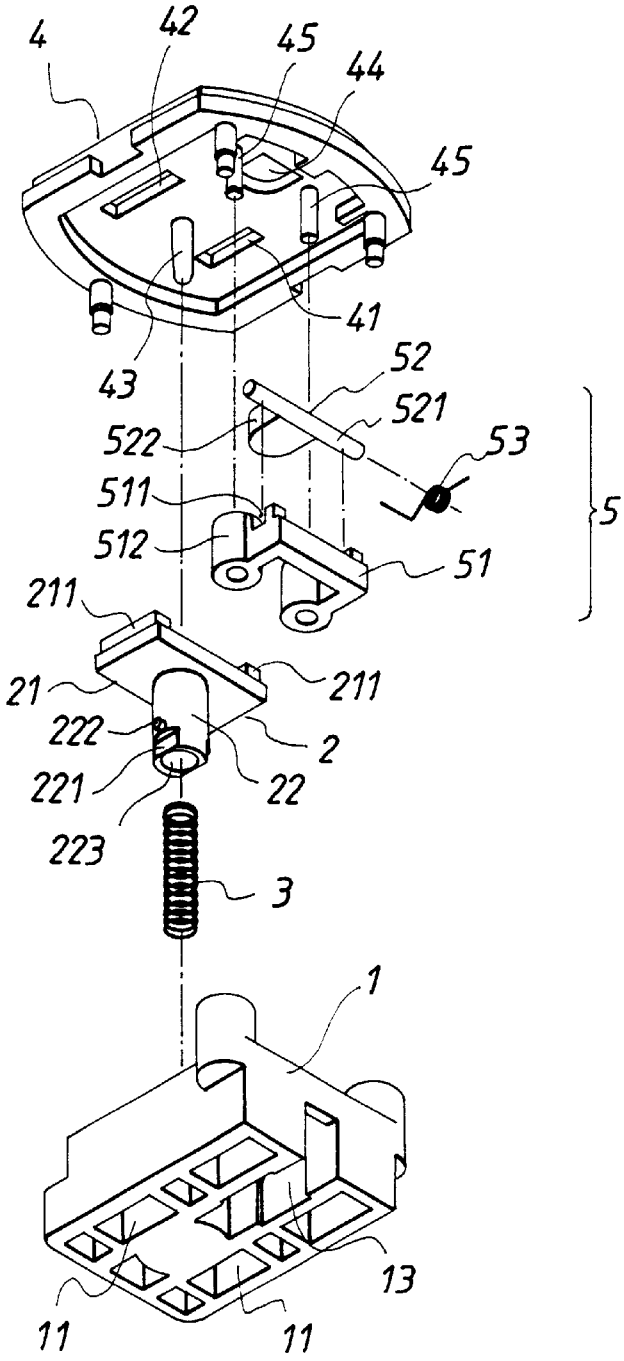
FIG. 1 is a three-dimensional exploded perspective of the invention.
Figure 2:
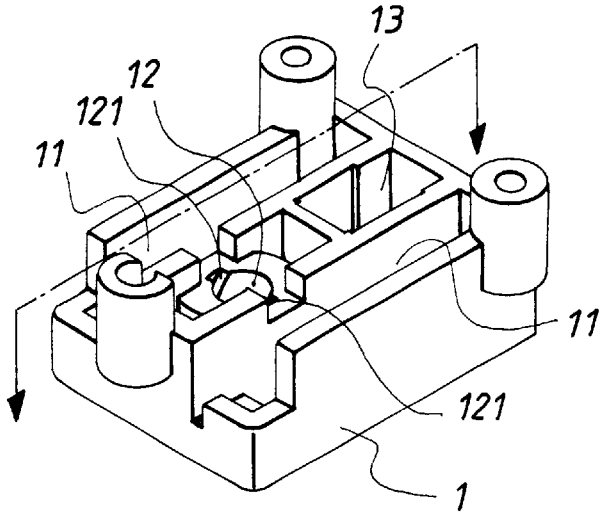
FIG. 2 is a three-dimensional perspective of the chassis compartment of the invention.
Figure 3:
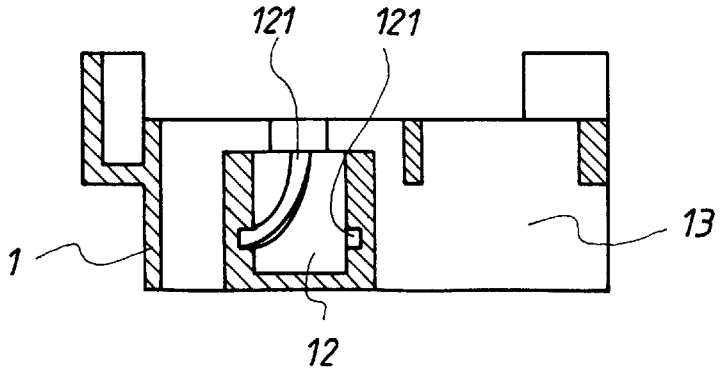
FIG. 3 is a cross-section view of the chassis compartment of the invention.

Referring to FIG. 1, it is seen that the invention design of Socket with Safety Device consists essentially of: a chassis 1, a security member 2, a resilient member 3 and insert lid 4, whereof:

Chassis 1, such as is illustrated in FIG. 2 and FIG. 3, is basically a rectanguloid incorporating a rectangular chute 11 formed on both sides thereof interiorly. The chutes 11 serve to house conventional parts, including conductor pieces. In-between both chutes 11, centrally in the chassis 1, there is formed a round blind hole 12, which is surrounded by a concave helical guide grooves 121, forming a pair in both of lateral or longitudinal holed walls. The pair of helical guided groove 121 extending largely abiding by a same helical orientation way from the top edge of the blind hole 12 to the bottom of the same blind hole 12. Also, on a chosen side of the blind hole 12, in front or at rear, there may be provided additionally a container groove 13.

The security member 2, structured largely in a T shape, consists of a traverse-going (transversely-extending) bumper 21 and a rod 22 extending way from the base of the bumper 21 centrally downwards. On either side of the top of the bumper 21 there is a rectangular shoe 211. Across the center of the rod 22 there penetrates a round passage hole 223 which vertically penetrates the security member 2. On either of both sides of the base of the rod 22 is formed a plane gap 221 on top of which flush with the rod juts a detent 222.

The resilient member 3 is essentially a helicoid compression spring.

The insert lid 4 serves to give access to the frontal legs of an ingoing plug for connection to electrical power. The insert lid 4 comprises a B plus hole 41 and a grounding hole 42, and a round rod 43 projecting between both said B plus hole 41 and the grounding hole 42. Moreover, central to the insert lid 4 in front or at rear there can be provided a neutral, static insert hole 44 on either end on the bottom thereof there protrudes respectively an insertion stems 45 onto which a dust prevention unit 5 is mounted;

The dust prevention unit 5 incorporates essentially: a hinge set 51, a seal lid 52 and a torsion spring 53. The hinge set 51 is configured roughly to resemble the minuscule alphabet 'n'. On each of both side boards is formed a hinged gap 511, the frontal tip of each side board being bound with a sleeving 512. The seal lid 52, being an articulating rod 521, has a lid board 522 protruded way from its mid-point, whereby both ends of the articulating rod 521 are brought into the hinge notch 511 on the hinge set 51, with the torsion spring 53 seated between both, whereupon it is made possible for the sleeving 512 on the hinge set 51 to be plunged about the insertion rod 45 in rapport to the insert lid 4, and the seal lid 52 responding to seal the neutral hole 44 for dust prevention.

Figure 4:
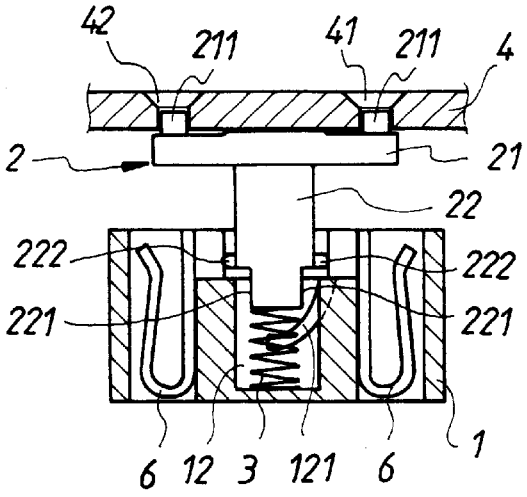
FIG. 4 is a partially taken cross-section view of the invention accomplished of assemblage.
Figure 5:
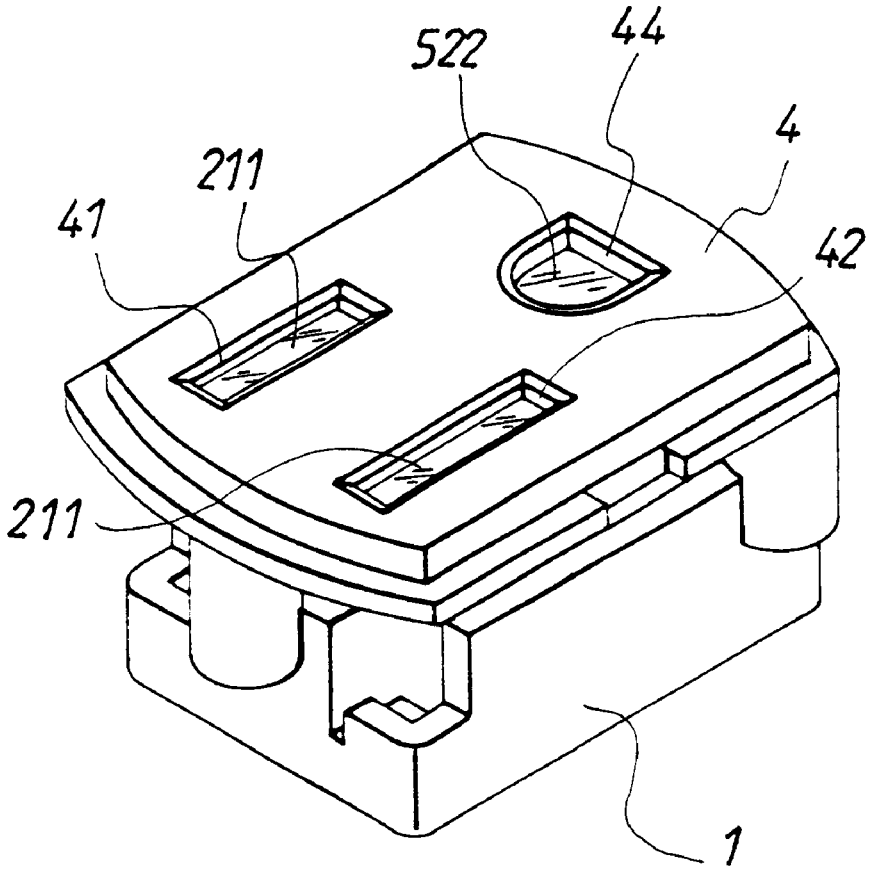
FIG. 5 is an apparent view of the invention accomplished of assemblage.

For assemblage to form a socket with safety feature based on such components as aforementioned chassis 1, safety member 2, resilient member 3 and insert lid 4, such as is demonstrated in FIG. 1, the first step is to install the resilient member 3, before anything else, into the blind hole 12 on the chassis 1. The security member 2 is shrouded onto the guide rod 43 on the insert lid 4 by way of its passage hole 223, so that the rod 22 of the security member 2 is maintained in a downward position. The insert lid 4 is secured to the top of chassis 1, like what is shown in FIG. 4. Concerning the security member 2, by having the frontal tip of the rod 22 protruded into the blind hole 12, and bearing the security member 2 upwards by means of the rebounding force of the resilient member 3, the two rectangular shoes 211 on the bumper 21 will wedge respectively into the B plus hole 41 and the grounding hole 42 on the insert lid 4, while the two detents 222 on the rod 22 of the security member 2 are arranged respectively above the two helical guide grooves 121. By mounting the dust preventor 5 underneath the insert lid onto the container chute 13 on the chassis 1, a socket with a safety feature according to the invention is realized, like what is shown in FIG. 5.

Figure 6:
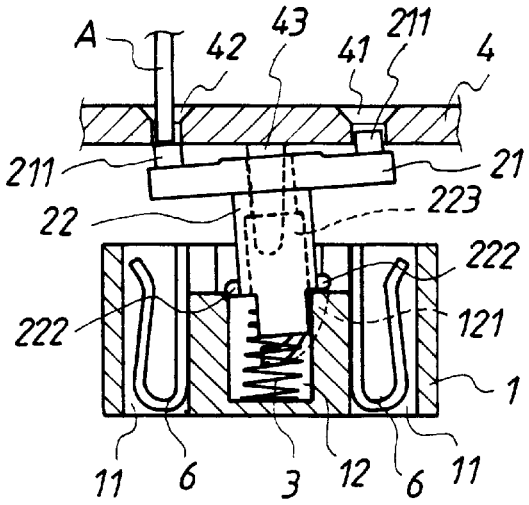
FIG. 6 is an illustration of the security mechanism of the invention.

Effects achievable and realized with the invention lie in that when naughty kids or innocent parties attempted with a ferrous implement A to challenge singly the B plus hole 41 or the grounding hole 42. As shown in FIG. 6, when the implement acts single-sidedly upon the rectangular shoe 211 in rapport to the security member 2, an angular displacement on the part of the security member will ensue, resulting in one detent 222 being retained on the rim of the helical guide groove 121. In this situation the security member 2 is restricted from a sinking movement, and entry by insertion of the intruding implement A is effectively blocked. This means for all purposes and intents that naughty kids are safeguarded from shocking risks when frolicking mischievously with a socket structured according to the invention. A further advantage with said security member 2 in conjunction with the tightly sealed B plus hole 41 and grounding hole, 42 is the prevention of accumulation of moisture, dust buildup, and tiny insects within, and that it will help to procrastinate the speed of oxidation of the conductor piece inside 6, and that means prolonged service term in the long run.

Figure 7:
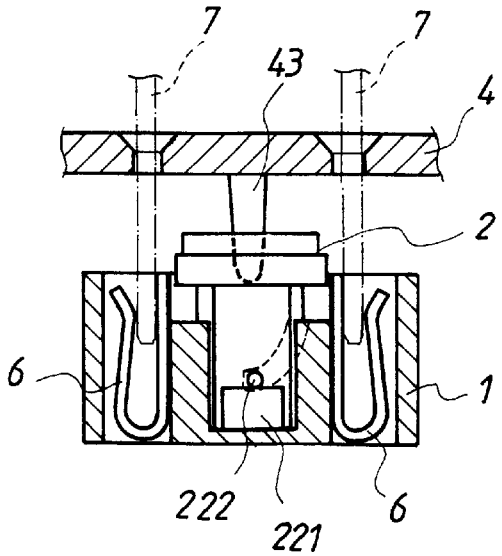
FIG. 7 is an illustration of the invention in a course of just and fair operation.
Figure 8:
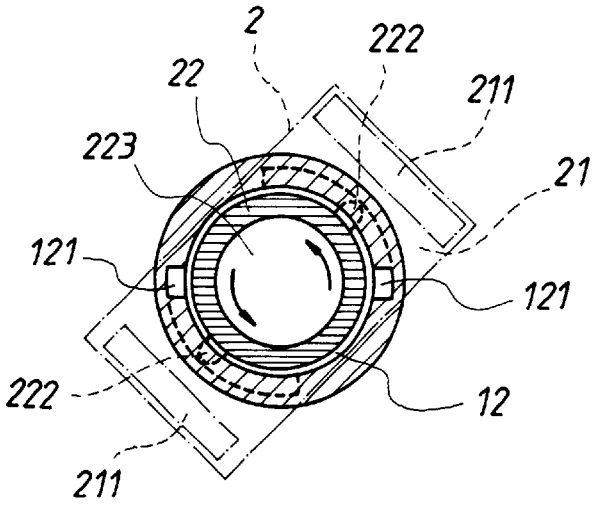
FIG. 8 is an illustration of the security member of the invention as to how it rotates in operation.
Figure 9:
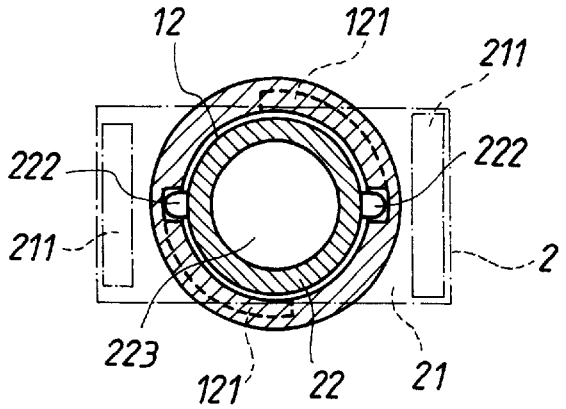
FIG. 9 is an illustration of the security member of the invention as to how it rotates back to position, in a resetting process; and, FIG. 10 is an illustration of the dust prevention feature of the invention in action.

When the user, holding a plug firmly and correctly plugs into the socket with both legs headlong 7 to access the power supply, as shown FIG. 7, both legs 7 are entered flat and parallel synchronously, and the security member 2 is pushed down to the point where the two detents 222 are respectively engaged into the helical guide groove 121. The guidance then taking place in the groove 121 suffices to switch the security member 2 to a revolving movement, like what is shown in FIG. 8, whereupon both legs 7 will come into contact with the conductor pieces 6, and conduction for power access is made. As the plug is withdrawn when the power supply is no longer needed, the thrust due to the resilient member 3 will kick the security member back to a closure status, the reset state, as shown in FIG. 9. In short, this invention is not only good as regards safety feature, but also convenient enough for use.

Figure 10:
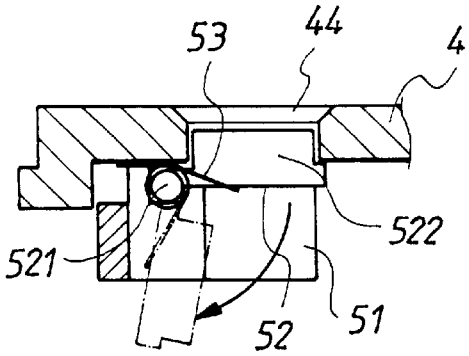

In instances where the invention is embodied to incorporate a neutral insert hole 44, the presence of a dust preventor 5 on the base of the insert lid will push apart the seal lid 52 against the intrusion of a neutral leg which is part of a plug being applied onto the socket. As shown in FIG. 10, when the plug is withdrawn the rebounding effect by the torsion spring 53, it will still suffice to revert the seal lid 52 back to closure state. This design of the dust preventer 5 serves to prevent inroads not only of dusts, but also of moisture buildup. It is noted that the interior of the neutral hole 44 is exempt from any electric power, serving merely as a grounding medium. In other words, although the seal lid 52 to the dust preventor 5 may be pushed apart independently, it does not necessarily expose kids to electric shock and the safety feature achieved by the invention stands unchallenged with proven excellence.

All in all, the design of a socket with safety device according to the invention, by virtue of its novelty and creativity traits is considered a truly worthy piece of invention.

What is claimed is:

1. An electrical socket with safety device, comprising a chassis, a security member, a resilient member, and an insert lid;

the chassis having a rectanguloid shape including two rectangular chutes extending through the chassis on the sides of the chassis, the chutes housing electrical elements of the electrical socket including conductor pieces, the chassis including a blind hole arranged centrally in the chassis between the chutes, the blind hole including a cylindrical wall having a top and a pair of concave helical grooves that extend longitudinally on opposing sides of the cylindrical wall, the pair of helical grooves extending in a matching helical orientation along the opposing sides of the cylindrical wall from openings on the top of the blind hole;

the security member having a T shape and including a bumper that extends transversely and a rod arranged centrally on the bumper and extending downward, the bumper having a top and two ends and a rectangular shoe respectively provided on the top of the bumper at the two ends thereof; the rod having an axis, a bottom and opposing sides; a passage hole extending along the axis of the rod, and two protruding detents respectively arranged on the opposing sides of the rod at the bottom of the rod; and the insert lid being secured to a top of the chassis and including a B plus hole, a grounding hole, and a round rod; the round rod being arranged between the B plus hole and the ground hole and received in the passage hole of the security member;

wherein the rod of the security member is arranged within the blind hole of the chassis, the resilient member is arranged between the chassis and the security member for biasing the security member upward so that the rectangular shoes of the security member are received in the B plus hole and the grounding hole of the insert lid, and the protruding detents on the rod are arranged above the openings of the helical grooves of the chassis, and the chassis, the security member, the resilient member, and the insert are arranged together for inhibiting access to the electrical elements housed in the chassis unless the rectangular shoes of the security member are simultaneously pushed into the chassis; whereby when rectangular shoes of the security member are simultaneously pushed into the chassis, the protruding detents on the rod are simultaneously received in the openings of the helical grooves of the chassis and slide in the helical grooves of the chassis so that the security member rotates and the electrical elements housed in the chassis are exposed; and when only one of the rectangular shoes of the security member is pushed into the chassis, the protruding detents on the rod are not received in the openings of the helical grooves of the chassis and cannot slide in the helical grooves of the chassis so that the security member cannot rotate and the electrical elements housed in the chassis are not exposed.

2. The electrical socket with safety device according to claim 1, wherein the resilient member is a helicoid compression spring.

3. The electrical socket with a safety device according to claim 1, wherein a plane notch is provided on the opposing sides of the rod of the security member, and the two protruding detents are arranged respectively on the rod above the plane notches.

4. The electrical socket with a safety device according to claim 1, wherein wherein a container groove is provided in the chassis.

5. The electrical socket with a safety device according to claim 1, wherein a neutral hole is provided in the insert lid, so that the neutral hole aligns with said container groove.

6. The electrical socket with a safety device according to claim 1, wherein an additional rod is provided on either side of the neutral hole on the insert lid for receiving a dust cover.

7. The electrical socket with a safety device according to claim 1, further comprising a dust cover including a hinge set, a seal lid and a torsion spring, the hinge set having a U shape where each leg of the U shape has hinge notch and ends of the legs respectively have a sleeve, the seal lid includes an articulating rod with a midpoint and ends, a lid board is provided at the midpoint of the articulating rod, and the ends of the articulating rod are received in the hinge notch on the hinge set, and the torsion spring is arranged to push the lid board of the articulating rod into the neutral hole of the insert lid for preventing dust from entering the electrical socket.

8. The electrical socket with a safety device according to claim 1, wherein the protruding detents on the rod of the security member are spaced from the openings of the helical grooves on the chassis.

* * * * *